US007898490B2

(12) United States Patent
Ohno

(10) Patent No.: US 7,898,490 B2
(45) Date of Patent: Mar. 1, 2011

(54) PRIMARY RADIATOR, LOW NOISE BLOCKDOWNCONVERTER AND SATELLITE BROADCASTING RECEIVING ANTENNA

(75) Inventor: Satoru Ohno, Matsubara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 81 days.

(21) Appl. No.: 12/174,201

(22) Filed: Jul. 16, 2008

(65) Prior Publication Data

US 2009/0021441 A1 Jan. 22, 2009

(30) Foreign Application Priority Data

Jul. 17, 2007 (JP) ..... 2007-185798

(51) Int. Cl.
*H01Q 13/02* (2006.01)

(52) U.S. Cl. ..... 343/776; 343/786

(58) Field of Classification Search ..... 343/772, 343/776, 786, 878, 879
See application file for complete search history.

(56) References Cited

U.S. PATENT DOCUMENTS 4,658,258 A 4/1987 Wilson
6,483,475 B1 * 11/2002 Tokuda ..... 343/786
6,864,850 B2 * 3/2005 Imaizumi et al. ..... 343/776
7,205,951 B2 * 4/2007 Matsui ..... 343/786
2003/0218574 A1 11/2003 Suga

FOREIGN PATENT DOCUMENTS

| | | | |
|---|---|---|---|
| JP | 60-132406 | A | 7/1985 |
| JP | 7-303007 | A | 11/1995 |
| JP | 10-150317 | A | 6/1998 |
| JP | 11-041028 | A | 2/1999 |
| JP | 11-274847 | A | 10/1999 |
| JP | 2003-273762 | A | 9/2003 |
| JP | 2004-336154 | A | 11/2004 |

OTHER PUBLICATIONS

Kojien, Fifth Edition, ed. Izurua Shinmura, Iwanami Shoten, Nov. 11, 1998, p. 2201.

* cited by examiner

*Primary Examiner*—Michael C Wimer
(74) *Attorney, Agent, or Firm*—Birch, Stewart, Kolasch & Birch, LLP

(57) ABSTRACT

A primary radiator includes two horns each having an opening on a larger-diameter side and an opening on a tapered smaller-diameter side opposite to the larger-diameter side, and two corrugated portions provided around the opening on the larger-diameter side of the horn. The outermost corrugated portion is formed to surround all of the horns, and the outermost corrugated portion is formed of one sheet metal member. With this structure, sheet-metal processing can be used to form horns of adaptable shapes and a plurality of horns can be formed at a time.

10 Claims, 9 Drawing Sheets

PRIMARY RADIATOR, LOW NOISE BLOCKDOWNCONVERTER AND SATELLITE BROADCASTING RECEIVING ANTENNA

This nonprovisional application is based on Japanese Patent Application No. 2007-185798 filed on Jul. 17, 2007 with the Japan Patent Office, the entire contents of which are hereby incorporated by reference.

BACKGROUND OF THE INVENTION

1. Field of the Invention

The present invention relates to a primary radiator used for receiving satellite broadcasting, a low noise blockdownconverter (hereinafter referred to as "LNB") using the primary radiator and a satellite broadcasting receiving antenna.

2. Description of the Background Art

A first conventional example of a so-called dual horn will be described. The dual horn includes two horns arranged close to each other to form a main body of a primary radiator. Specifically, a die-casting die is used to mold only the dual horn or the dual horn together with the main body in one piece (see for example Japanese Patent Laying-Open No. 11-041028). As shown in FIG. 9 for example, this conventional dual-horn primary radiator molded by die casting includes two horns 21*a*, 21*b* and double corrugated portions 22*a*, 22*b*. A second conventional example of the dual horn uses sheet metals of similar shapes to form one primary radiator (see for example Japanese Patent Laying-Open No. 2004-336154).

The first conventional example, however, lacks adaptability in that for example the shape cannot be changed after the horn is once fabricated, because the horn which is a casting is fabricated using a mold. In the case where the shape of the horn is to be drastically changed, a new mold has to be prepared, which means the investment cost increases. Further, the second conventional example has the problem that only one primary radiator can be formed using the sheet metals of similar shapes.

SUMMARY OF THE INVENTION

The present invention has been made to solve the above-described problems. An object of the present invention is to provide a primary radiator, an LNB using the primary radiator and a satellite broadcasting receiving antenna for which sheet metal processing can be used to form a horn of a flexibly adaptable shape and to form a plurality of horns at a time.

In order to achieve this object, a primary radiator of the present invention includes: a plurality of horns each having an opening on a larger-diameter side and an opening on a tapered smaller-diameter side opposite to the larger-diameter side; and at least one corrugated portion provided around the opening on the larger-diameter side of the horns each. At least one corrugated portion includes an outermost corrugated portion formed to surround all of the plurality of horns, and the outermost corrugated portion is formed of one sheet metal member.

The primary radiator according to an embodiment of the present invention further includes a base plate to which the horns and the corrugated portion are fixed, at least one corrugated portion includes a plurality of corrugated portions including an innermost first corrugated portion, and a plurality of holes are made in the base plate. Respective ends on the smaller-diameter side of the horns are passed respectively through the plurality of holes, and respective peripheries of respective openings on the outer-diameter side of the horns are fixed to respective rims of the holes. The first corrugated portion is fixed to the base plate or to a receiving piece extending from the horns each such that the first corrugated portion is placed concentrically with the opening on the outer-diameter side of the horns each.

In a preferred embodiment of the primary radiator of the present invention, the corrugated portion has the first corrugated portion placed concentrically with each of the plurality of horns and a second corrugated portion provided on the outside of the first corrugated portion, and the second corrugated portion is formed in one piece bent from a perimeter of the base plate such that the second corrugated portion entirely surrounds respective first corrugated portions of all of the horns. Further, the primary radiator of the present invention may include a plurality of corrugated portions each formed of one sheet metal member.

In the primary radiator of the present invention, the horns and the corrugated portion are connected and fixed to each other by welding, electrically conductive adhesive, caulking or fastening using a fastening member, for example.

Regarding the primary radiator of the present invention having the structure as described above, the horn and the corrugated portion are formed of a combination of a plurality of sheet metal components so that the shape is flexibly adaptable. Further, various components may be prepared so that it is unnecessary to newly fabricate a mold. The distance between the horns can be freely adjusted. Moreover, horns formed of the sheet metal can be used to form the primary radiator including a plurality of horns.

The present invention includes an LNB having the above-described primary radiator as well as a satellite broadcasting receiving antenna having the LNB.

As compared with the above-described conventional examples which are each formed in basically one shape by casting (sheet metal processing) and thus change of the shape is difficult, the prevent invention provides the particular effects that the shape is flexibly adaptable and a die can be commonly used, so that the investment cost for the die can be reduced and a plurality of horns can be integrated into one piece by combination.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1A:
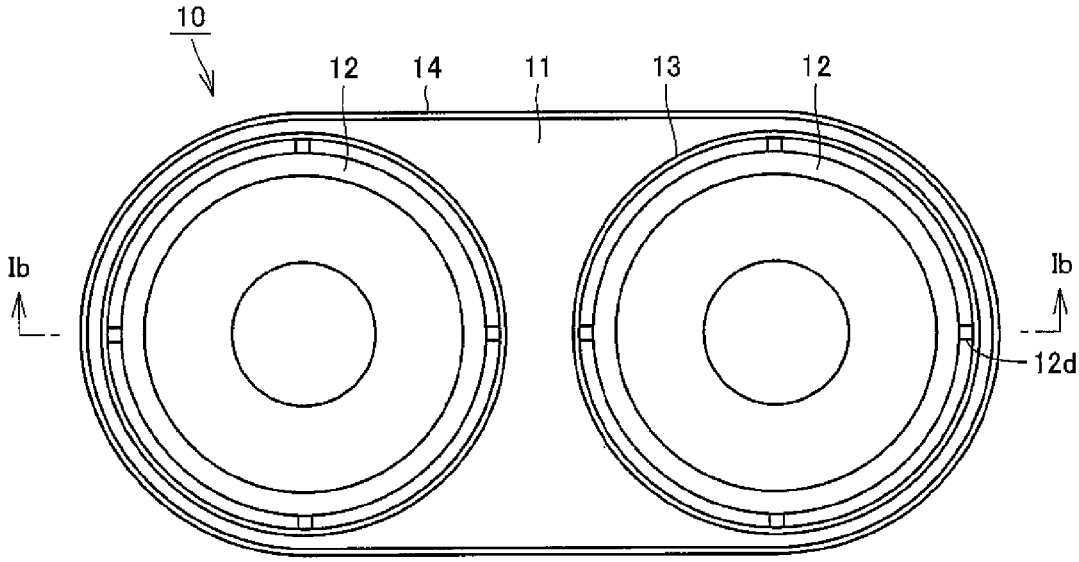
FIG. 1A is a plan view of a primary radiator according to an embodiment of the present invention.
Figure 1B:
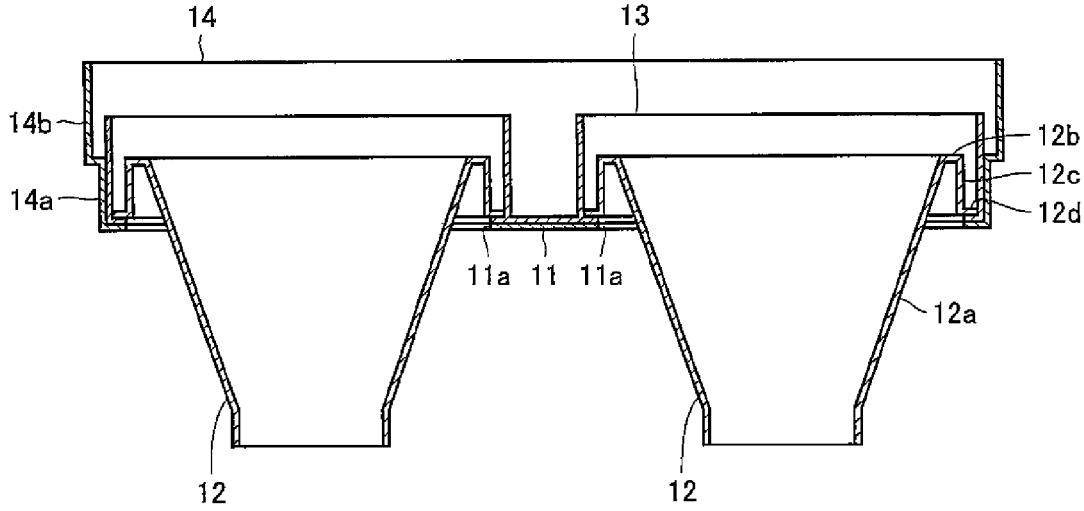
FIG. 1B is a cross section along a line Ib-Ib in FIG. 1A.

In the following, embodiments of the present invention will be described with reference to the drawings. As shown in FIGS. 1A and 1B, a primary radiator 10 according to an embodiment of the present invention includes two openings where sheet metal members are combined to form two horns 12, 12 and first and second corrugated portions 13, 14. In primary radiator 10, second corrugated portion 14 located on the outside is formed of one sheet metal member.

Specifically, in primary radiator 10 of the present embodiment, two holes are made in an oval base plate 11. The tapered smaller-diameter end of horn 12 is passed through the hole and the periphery of the opening on the larger-diameter side of horn 12 is fixed to the rim of the hole. The horn has a hollow conical main body 12*a*, and a flange 12*b*, a cylindrical leg 12*c* and a receiving piece 12*d* are formed in one piece to bent from the periphery of the opening on the larger-diameter side. Further, cylindrical first corrugated portion 13 is fixed between base plate 11 and receiving piece 12*d* extending from horn 12 such that a groove is formed concentrically with each horn 12.

Further, by sheet metal processing of one sheet metal member, oval second corrugated portion 14 is formed to surround first corrugated portion 13 from the perimeter of base plate 11 such that a groove is partially formed with the first corrugated portion. Second corrugated portion 14 includes a first body 14*a* partially contacting first corrugated portion 13 and a second body 14*b* forming the groove.

As seen from the above, while the conventional primary radiator having a plurality of horns is formed by die casting and thus the design of the mold has to be changed when the shape is to be changed, the present embodiment prepares a plurality of sheet metal components that are combined to form the horns and the corrugated portions so that the primary radiator can be shaped to have an equivalent performance to that achieved by die casting.

While the present embodiment shows the example of the structure in which the two horns are arranged close to each other and side by side, it is apparently seen that the embodiment is applicable to the structure in which three or more horns are arranged closed to each other and side by side. Moreover, while the present embodiment shows the example where two corrugated portions surrounding one horn are provided, the number of the corrugated portions is not limited to two and one or three or more corrugated portions may be provided.

Figure 2A:
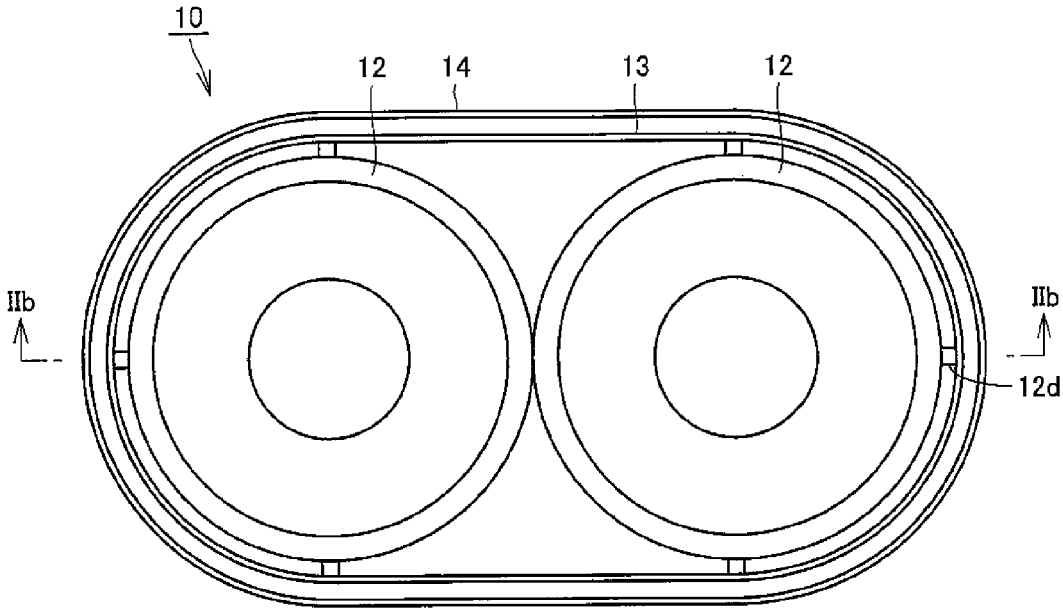
FIG. 2A is a plan view of a primary radiator according to another embodiment of the present invention.
Figure 2B:
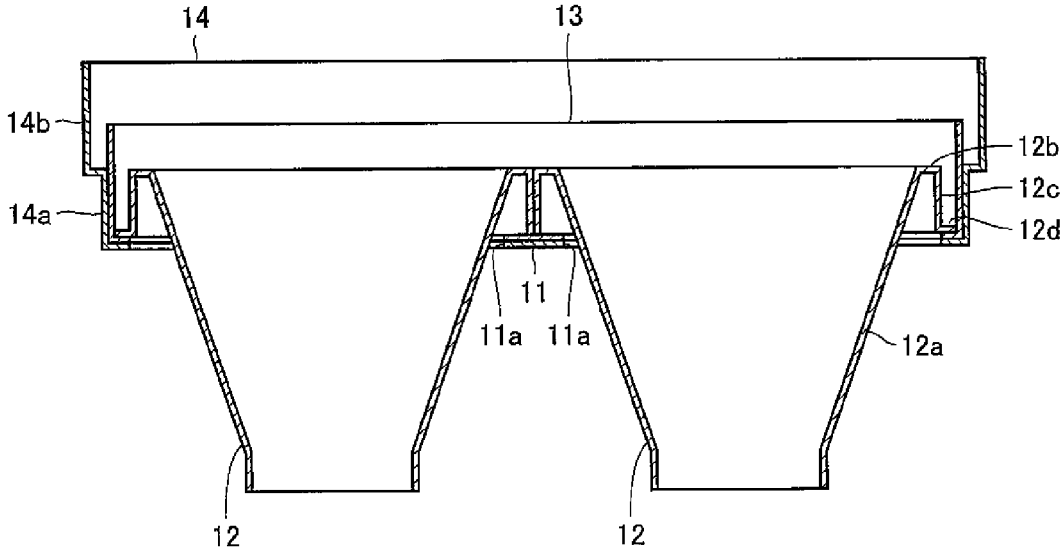
FIG. 2B is a cross section along a line IIb-IIb in FIG. 2A.

A primary radiator 10 according to another embodiment of the present invention will be described with reference to FIGS. 2A and 2B. In the present embodiment, in the case where the spacing between horns 12, 12 is small and the corrugated portion cannot be formed between horns 12, 12, a plurality of horns are integrated into one piece using corrugated portions of similar shapes adapted to the outer periphery. Specifically, FIGS. 2A and 2B show a primary radiator 10 including a plurality of openings where a plurality of sheet metal members are combined to form a plurality of horns 12, and two corrugated portions. Inner corrugated portion 13 and outer corrugated portion 14 are each formed of one sheet metal member.

Two holes are made in oval base plate 11, and the tapered smaller-diameter end of horn 12 is passed through the hole, the horns are arranged to contact each other, and the periphery of the opening on the larger-diameter side of the horn is fixed to the rim of the hole. The horn has hollow conical body 12*a*, and flange 12*b*, cylindrical leg 12*c* and receiving piece 12*d* are formed in one piece to bent from the periphery of the opening on the larger-diameter side.

First corrugated portion 13 of an expanded cylinder in shape is provided to partially form a groove with the horn, such that the first corrugated portion 13 surrounds the horn from the perimeter of base plate 11. The receiving piece of first corrugated portion 13 is fixed between base plate 11 and the receiving piece extending from horn 12.

By sheet metal processing of one sheet metal member, the second corrugated portion is formed in one piece and bent from the perimeter of base plate 11. Second corrugated portion 14 of an expanded cylinder in shape is provided to surround first corrugated portion 13 such that a groove is formed with first corrugated portion 13. Second corrugated portion 14 includes first body 14*a* partially contacting first corrugated portion 13 and second body 14*b* forming the groove.

Figure 3A:
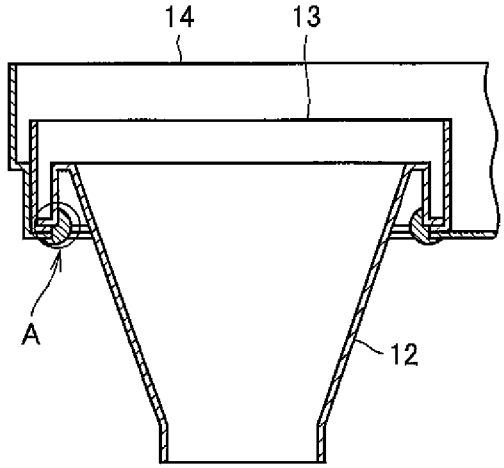
FIG. 3A is a cross section of the primary radiator shown in FIGS. 1A and 1B in which a horn and corrugated portions are fixed by welding (metal joining)
Figure 3B:
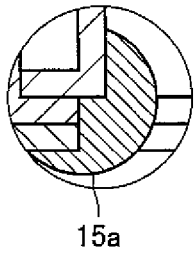
FIG. 3B is an enlarged cross section of the portion inside a circle A in FIG. 3A.
Figure 3C:
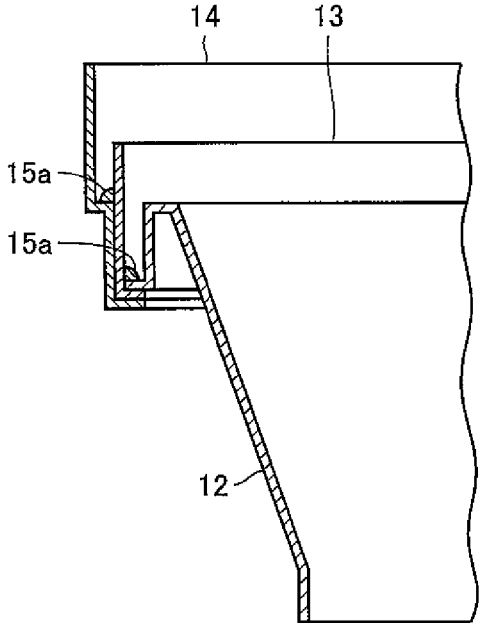
FIG. 3C is a cross section showing a structure in which the horn and a first corrugated portion are welded together and the first corrugated portion and a second corrugated portion are welded together.

A fixing structure for the horn and the corrugated portions will be described. FIGS. 3A, 3B and 3C show two different exemplary structures for fixing the horn and the corrugated portions by welding (metal joining) 15*a*. The exemplary structure in FIGS. 3A and 3B shows that, in the state where the base plate, first corrugated portion 13 and horn 12 are laid on each other in this order, welding is applied from the inner side of the leg of horn 12. The joining may be the whole-periphery welding or point welding. The whole-periphery welding can keep air-tightness. FIG. 3C shows a cross-sectional structure in the case where horn 12 and first corrugated portion 13 are welded and first corrugated portion 13 and second corrugated portion 14 are welded.

Figure 4A:
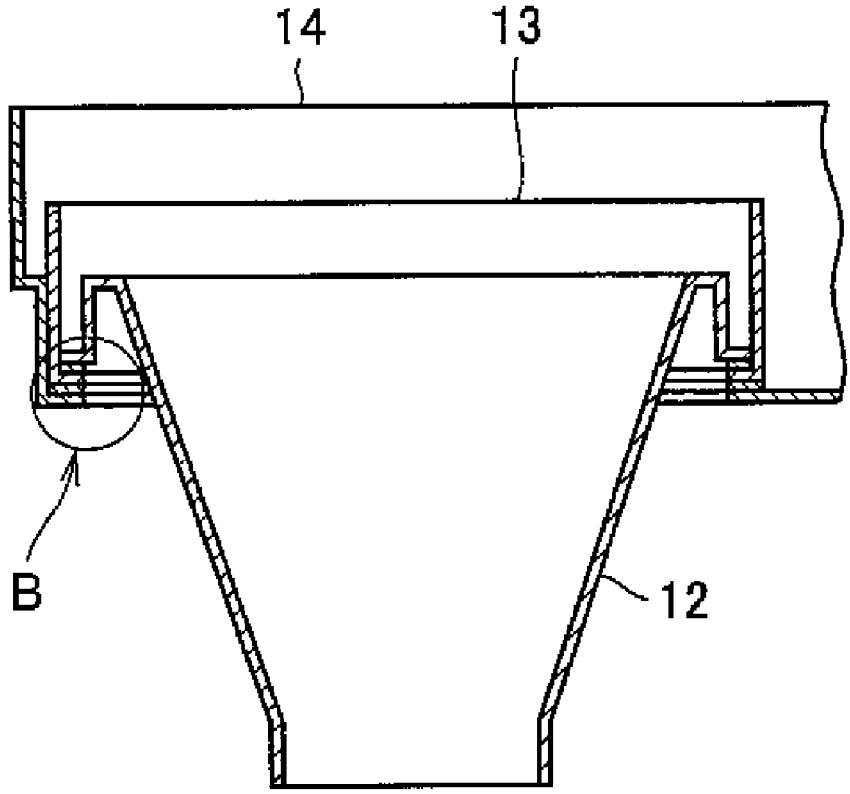
FIG. 4A is a cross section of the primary radiator shown in FIGS. 1A and 1B in which the horn and the corrugated portions are fixed with an adhesive.
Figure 4B:
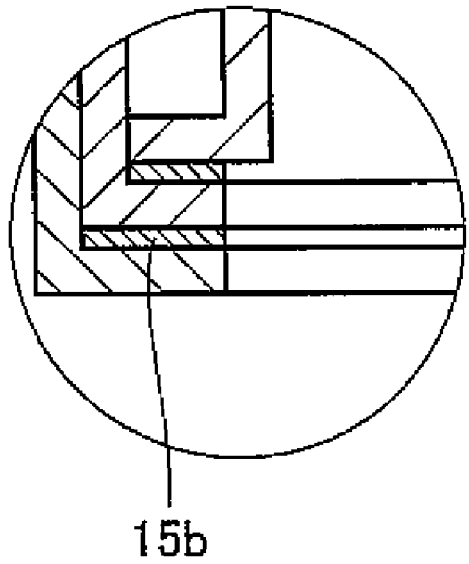
FIG. 4B is an enlarged cross section of the portion inside a circle B in FIG. 4A.

FIGS. 4A and 4B show an exemplary structure in which the horn and the corrugated portions are fixed using an electrically conductive adhesive (tape) 15*b*. Specifically, in the state where the base plate, first corrugated portion 13 and horn 12 are laid on each other in this order, an adhesive layer is provided between these members. The joining may also be whole-periphery bonding or point bonding in this exemplary structure.

Figure 5A:
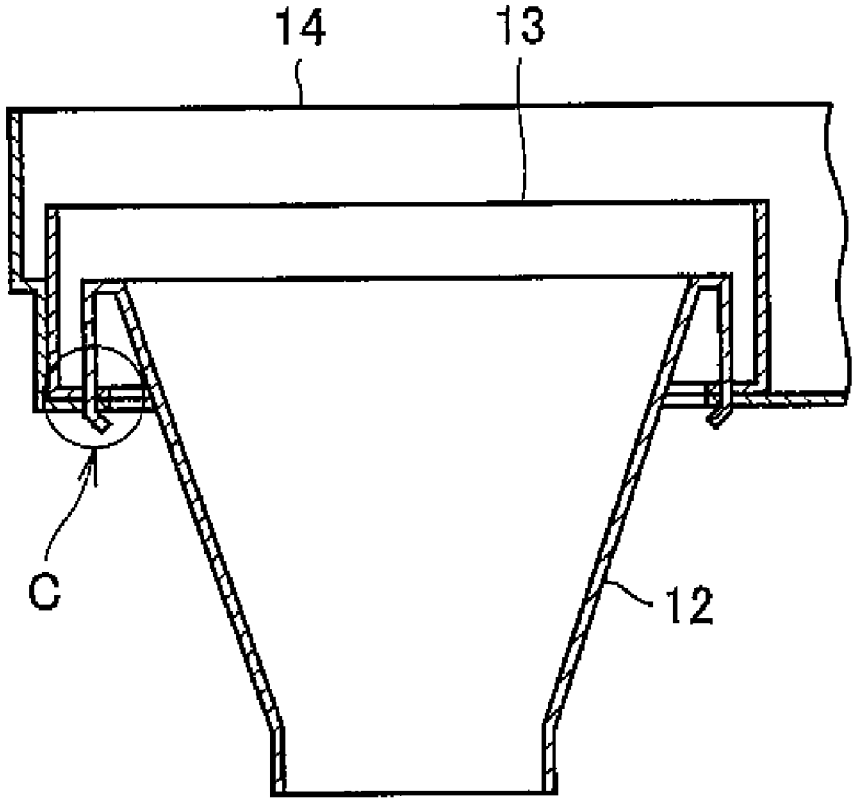
FIG. 5A is a cross section of the primary radiator shown in FIGS. 1A and 1B in which the horn and the corrugated portions are fixed to each other by caulking.
Figure 5B:
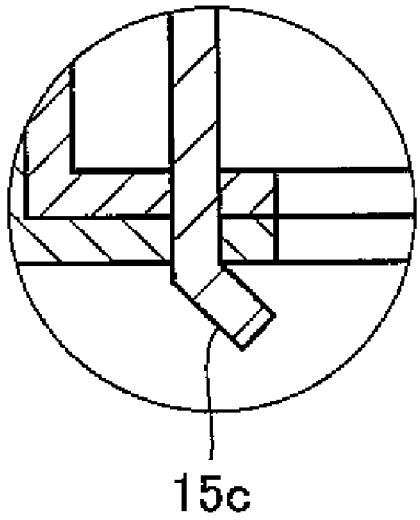
FIG. 5B is an enlarged cross section of the portion inside a circle C that is a caulking-fixed portion in FIG. 5A.

FIGS. 5A and 5B show an exemplary structure in which the horn and the corrugated portions are fixed using a caulked structure 15*c*. Specifically, in the state where the base plate and the receiving piece of first corrugated portion 13 are laid on each other, a plurality of holes are made in the circumferential direction, and portions for caulking passing through these holes are provided to protrude from the end of the leg portion of horn 12. The portions for caulking are then caulked.

Figure 6A:
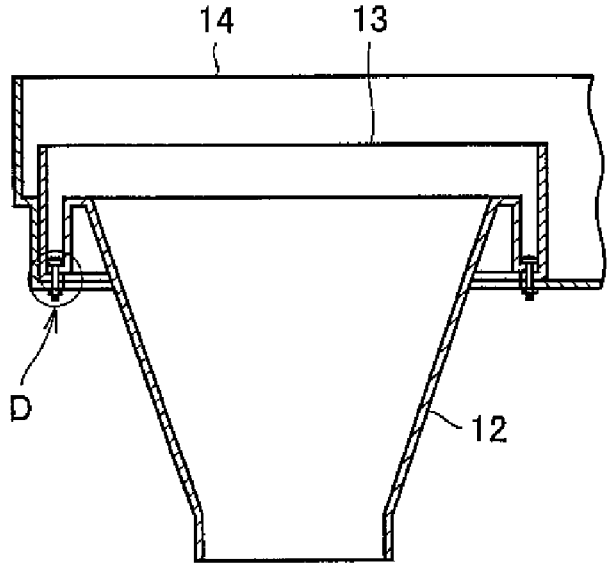
FIG. 6A is a cross section of a horn and corrugated portions having a co-screw-fixed portion using a separate component.
Figure 6B:
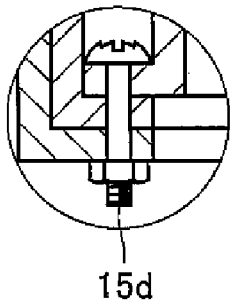
FIG. 6B is an enlarged cross section of the portion inside a circle D in FIG. 6A.
Figure 6C:
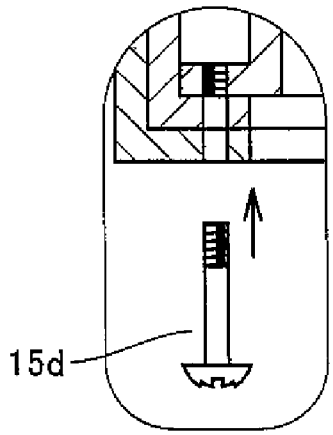
FIG. 6C is an exploded enlarged cross section of the portion inside circle D in FIG. 6A in the case where a generally used screwing is used in the co-screw-fixed portion.

FIGS. 6A and 6B show an exemplary structure in which horn 12 and the corrugated portions are fixed using a separate component 15*d*. In FIGS. 6A and 6B, in the state where horn 12 and first and second corrugated portions 13 and 14 are laid on each other, a hole is made and a headed screw 15*d* and a nut are used for fixing them in the hole. FIG. 6C shows an exemplary structure in which a screw hole is made in the receiving piece of horn 12 and headed screw 15*d* inserted from below is screwed in the screw hole for fixing them.

Figure 7:
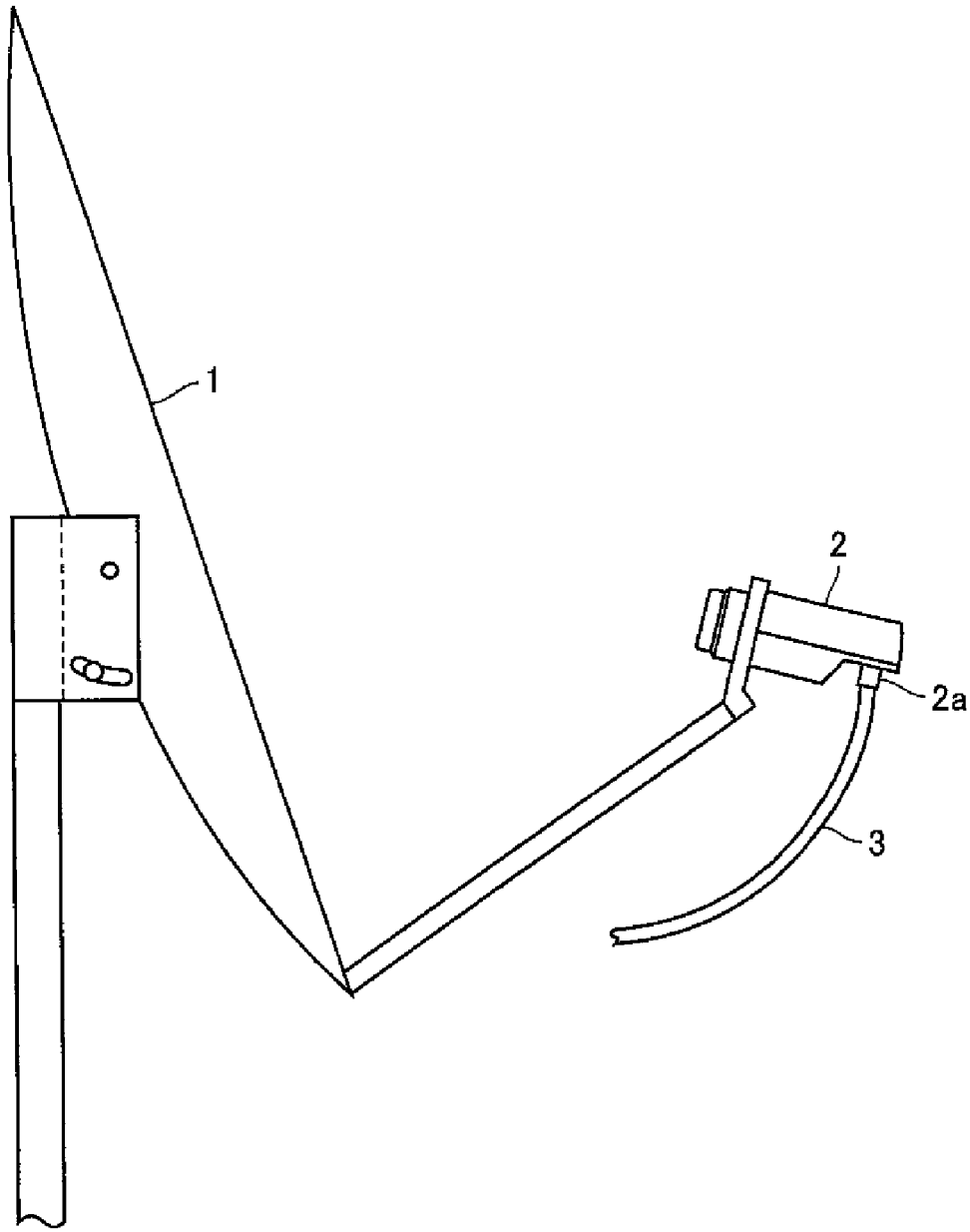
FIG. 7 is a front view of a satellite broadcasting receiving antenna.
Figure 8A:
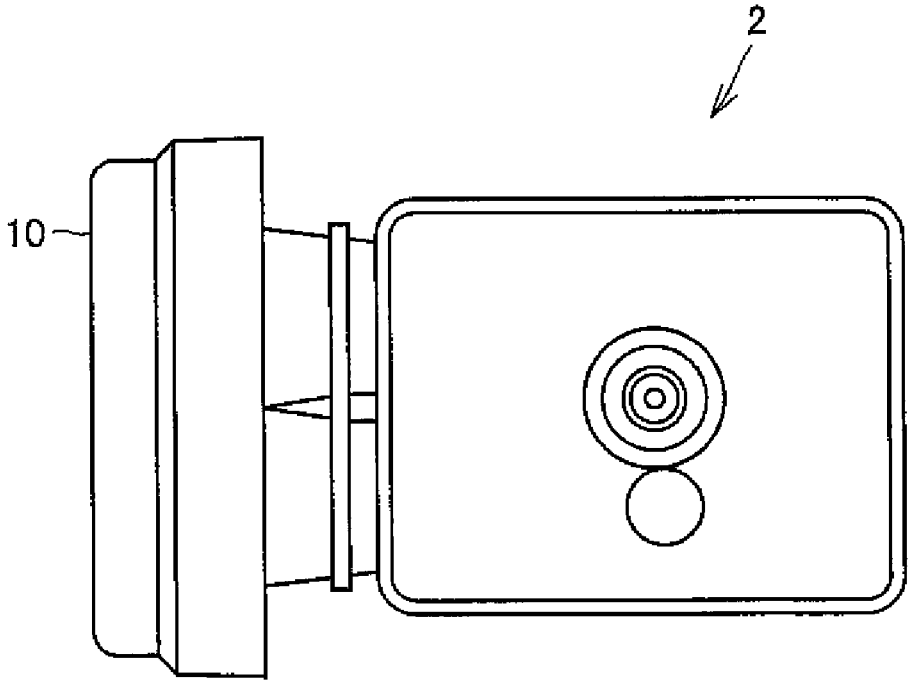
FIG. 8A is a plan view of a structure according to one embodiment of an LNB apparatus.
Figure 8B:
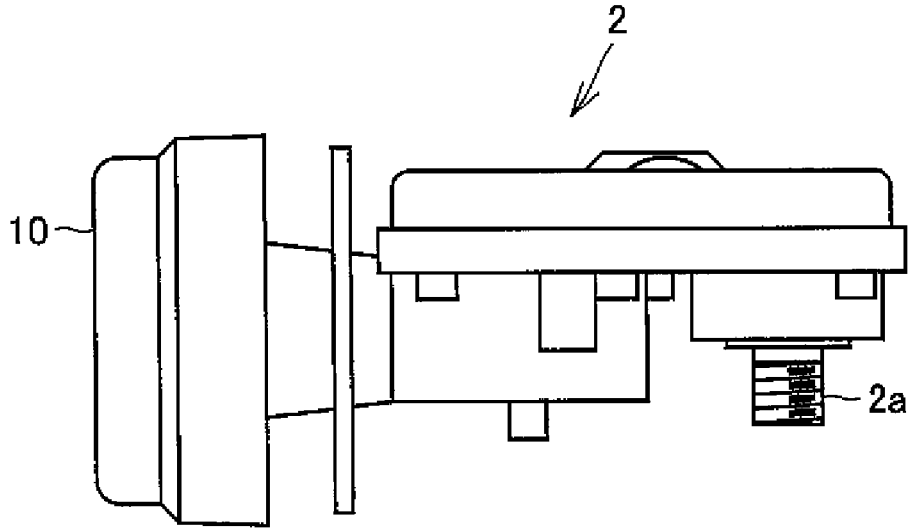
FIG. 8B is a front view thereof.
Figure 9:
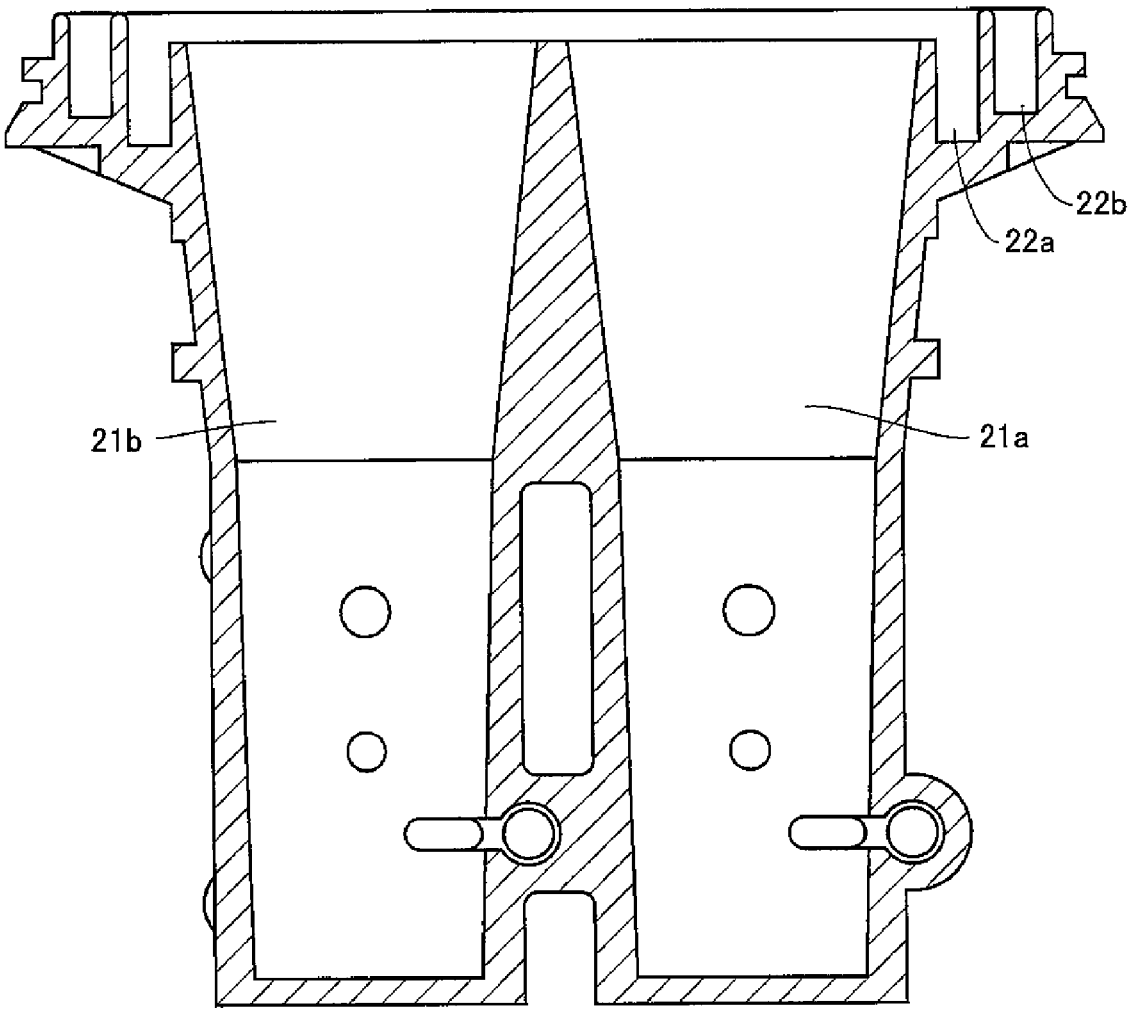
FIG.9 PRIOR ART
FIG. 9 is a cross section of an example of a conventional die-cast primary radiator.

A satellite broadcasting receiving antenna uses the primary radiator to which the present invention is applied. As shown in FIGS. 7, 8A and 8B, the electromagnetic wave caught by an antenna 1 enters primary radiator 10 incorporated in an LNB apparatus 2, thereafter enters a built-in circuit board, and is frequency-converted and thereafter output from an F connector 2*a*.

While the above embodiments show the example of the structure in which two horns are arranged close to each other and side by side, the embodiments are applicable as well to the structure in which three or more horns are arranged close to each other and side by side. Further, the number of corrugated portions is not limited to two, and one or three or more corrugated portions may be provided.

Although the present invention has been described and illustrated in detail it is clearly understood that the same is by way of illustration and example only and is not to be taken by way of limitation, the scope of the present invention being interpreted by the terms of the appended claims.

What is claimed is:

1. A primary radiator comprising:

a plurality of horns each having an opening on a larger-diameter side and an opening on a tapered smaller-diameter side opposite to the larger-diameter side;

at least one corrugated portion provided around each of said opening on the larger-diameter side of said horns;

said at least one corrugated portion including an outermost corrugated portion being formed to surround all of said plurality of horns and including an innermost corrugated portion being formed to surround one of said plurality of horns, and said outermost corrugated portion being formed of one sheet metal member;

a base plate to which said horns and said at least one corrugated portion are fixed;

said at least one corrugated portion includes a plurality of corrugated portions including the innermost corrugated portion;

a plurality of holes are made in said base plate, respective ends on said smaller-diameter side of said horns are passed respectively through said plurality of holes, and respective peripheries of respective openings on said larger-diameter side of said horns are fixed to respective rims of said holes; and said innermost corrugated portion is fixed to said base plate or to a receiving piece extending from each of said horns such that said innermost corrugated portion is placed concentrically with said opening on the larger-diameter side of each of said horns, wherein the one of said plurality of horns is separately provided from the innermost corrugated portion, where the one of said plurality of horns fits into the innermost corrugated portion.

2. The primary radiator according to claim 1, wherein said at least one corrugated portion includes said innermost corrugated portion placed concentrically with each of said plurality of horns and an outermost corrugated portion provided on the outside of said innermost corrugated portion, and said outermost corrugated portion is formed in one piece bent from a perimeter of said base plate such that said outermost corrugated portion entirely surrounds respective innermost corrugated portions of all of said horns.

3. The primary radiator according to claim 1, wherein said at least one corrugated portion includes said innermost corrugated portion and said outermost corrugated portion, and said innermost corrugated portion and said outermost corrugated portion are each formed of one sheet metal member.

4. The primary radiator according to claim 1, wherein said horns and said at least one corrugated portion are fixed to each other by welding.

5. The primary radiator according to claim 1, wherein said horns and said at least one corrugated portion are fixed to each other by an electrically conductive adhesive.

6. The primary radiator according to claim 1, wherein said horns and said at least one corrugated portion are fixed to each other by caulking.

7. The primary radiator according to claim 1, wherein said horns and said at least one corrugated portion are fixed to each other via a fastening member.

8. A low noise blockdownconverter including the primary radiator as recited in claim 1.

9. A satellite broadcasting receiving antenna including the low noise blockdownconverter as recited in claim 8.

10. The primary radiator according to claim 1, wherein said one of said plurality of horns includes a receiving piece formed from the periphery of the opening on the larger-diameter side of the said one of said plurality of horns so that the one of said plurality of horns fits into the innermost corrugated portion.

* * * * *